US006743030B2

(12) United States Patent
Lin et al.

(10) Patent No.: US 6,743,030 B2
(45) Date of Patent: Jun. 1, 2004

(54) PORTABLE STORAGE DEVICE WITH UNIVERSAL SERIAL BUS

(75) Inventors: Jao-ching Lin, Taoyuan (TW); Chien-cheng Huang, Taoyuan (TW); Tiem-shun Ma, Tucheng (TW)

(73) Assignee: Asia Vital Components Co., Ltd. (TW)

( * ) Notice: Subject to any disclaimer, the term of this patent is extended or adjusted under 35 U.S.C. 154(b) by 0 days.

(21) Appl. No.: 10/259,728

(22) Filed: Sep. 30, 2002

(65) Prior Publication Data

US 2004/0063346 A1 Apr. 1, 2004

(51) Int. Cl.[7] ..... H01R 13/44
(52) U.S. Cl. ..... 439/131
(58) Field of Search ..... 439/131, 140

(56) References Cited

U.S. PATENT DOCUMENTS 3,629,790 A * 12/1971 McSherry, Jr. ..... 439/140
4,445,739 A * 5/1984 Wooten ..... 439/140
4,780,604 A * 10/1988 Hasegawa et al. ..... 235/492
4,843,226 A * 6/1989 Kato et al. ..... 235/492
4,868,714 A * 9/1989 Banjo et al. ..... 361/737
5,037,319 A * 8/1991 Hatagishi ..... 439/140
5,047,894 A * 9/1991 Onoda et al. ..... 361/737
5,518,411 A * 5/1996 Belleci ..... 439/141
6,231,358 B1 * 5/2001 Kerr et al. ..... 439/140

* cited by examiner

*Primary Examiner*—Tulsidas C. Patel
(74) *Attorney, Agent, or Firm*—Bacon & Thomas, PLLC

(57) ABSTRACT

A portable storage device with universal serial bus has a connector that is movable out of or retractable into a case of the portable storage device. The case defines a chamber, in which a main body consisting of a circuit board and the connector is movably positioned. A push member is located above and connected to the main body by way of interference fit, and is exposed from a recess formed at a rear top of the case. By pushing the push member forward and rearward, the connector of the main body is caused to project from or retract into a front end of the case.

9 Claims, 7 Drawing Sheets

PORTABLE STORAGE DEVICE WITH UNIVERSAL SERIAL BUS

FIELD OF THE INVENTION

The present invention relates to a portable storage device with universal serial bus (USB), and more particularly to a portable storage device having a connector retractable into a case thereof.

BACKGROUND OF THE INVENTION

FIG. 1 is an exploded perspective view of a conventional portable storage device, which includes a case 5, a connector 6, and a cover 51 detachably connected to the case 5 to cover the connector 6. Wherein, the connector 6 is a USB connector.

The case 5 of the above-described conventional portable storage device is internally provided with circuits for storing and transmitting computer data, and is electrically connected to the connector 6, such that when the cover 51 is removed from the case 5 to expose the connector 6, the connector 6 may be directly plugged into a USB connector provided on a computer to function like an externally connected hard disk drive to transmit or store data. When the connector 6 is unplugged, the portable storage device can be carried by a user to any other place or be connected to another computer. Therefore, the portable storage device is highly mobile and convenient for use.

The connector 6 of the above-described conventional portable storage device is integrally connected to an end of the case 5, and is protected by the cover 51 against uselessness resulted from collision, damage, distortion or deformation of the connector 6. The cover 51 is completely separated from the case 5 once it is removed therefrom. In the event a user carelessly lost the separated cover 51, the connector 6 is no longer suitably protected and tends to become damaged, failed, and unusable.

It is therefore tried by the inventor to develop a portable storage device with a retractable connector to eliminate the drawbacks existed in the conventional portable storage device.

SUMMARY OF THE INVENTION

A primary of the present invention is to provide a portable storage device with universal serial bus (USB), so that a USB connector thereof may be freely retracted into a case to avoid undesired damage of the connector, and a user needs not to worry about any lost cover at all.

To achieve the above and other objects, the portable storage device with USB of the present invention mainly includes a case defining a hollow chamber having a front opening, a main body consisting of a circuit board and a connector located in front of the circuit board and being movably positioned in the hollow chamber of the case, and a push member located above and connected to the main body by way of interference fit to expose from a recess formed at a rear top of the case. When the push member is pushed forward and rearward, the connector of the main body is caused to project from or retract into a front end of the case.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
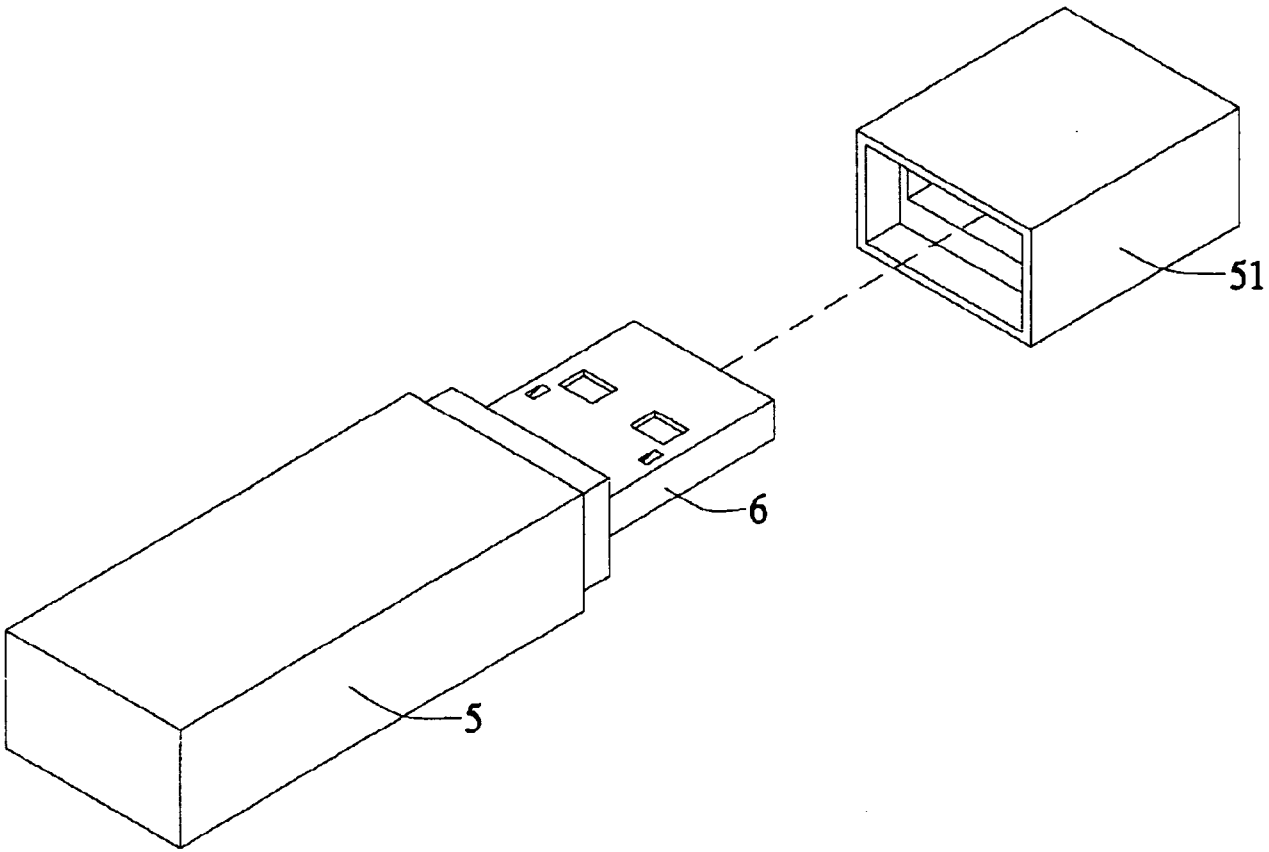
FIG.1 PRIOR ART
FIG. 1 is an exploded perspective view of a conventional portable storage device.
Figure 2:
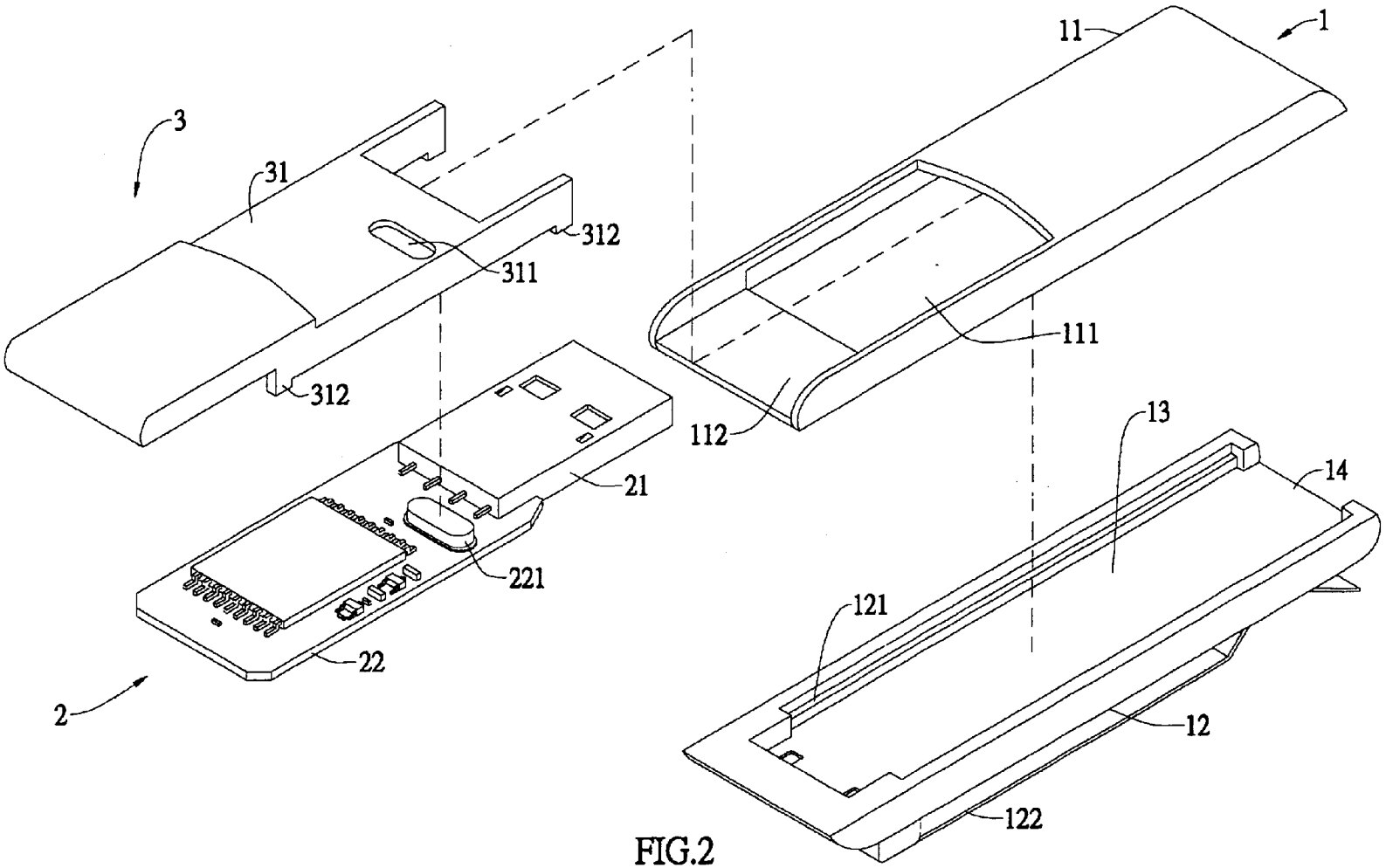
FIG. 2 is an exploded perspective view of a portable storage device with USB according to an embodiment of the present invention.
Figure 3:
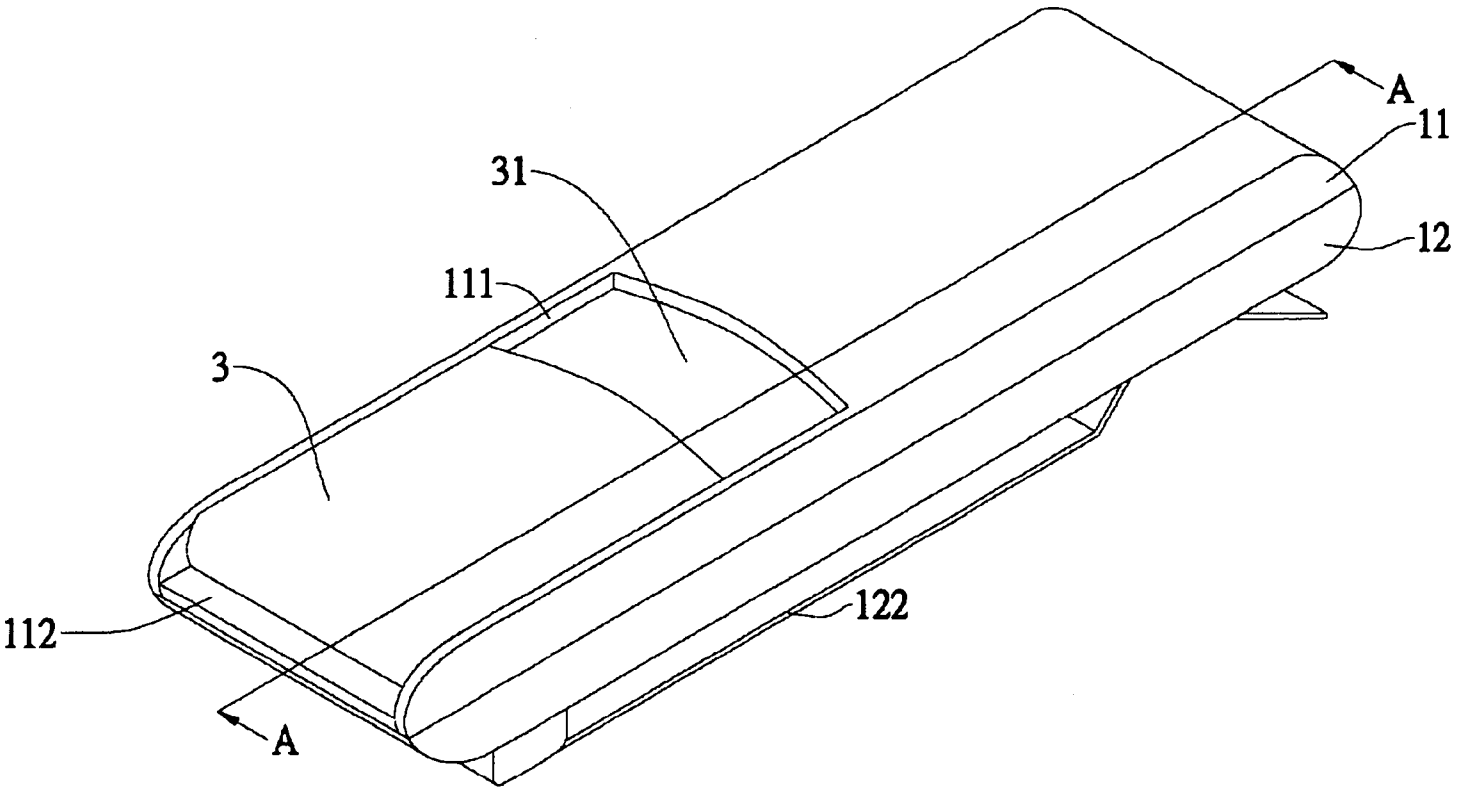
FIG. 3 is an assembled perspective view of FIG. 2.
Figure 4:
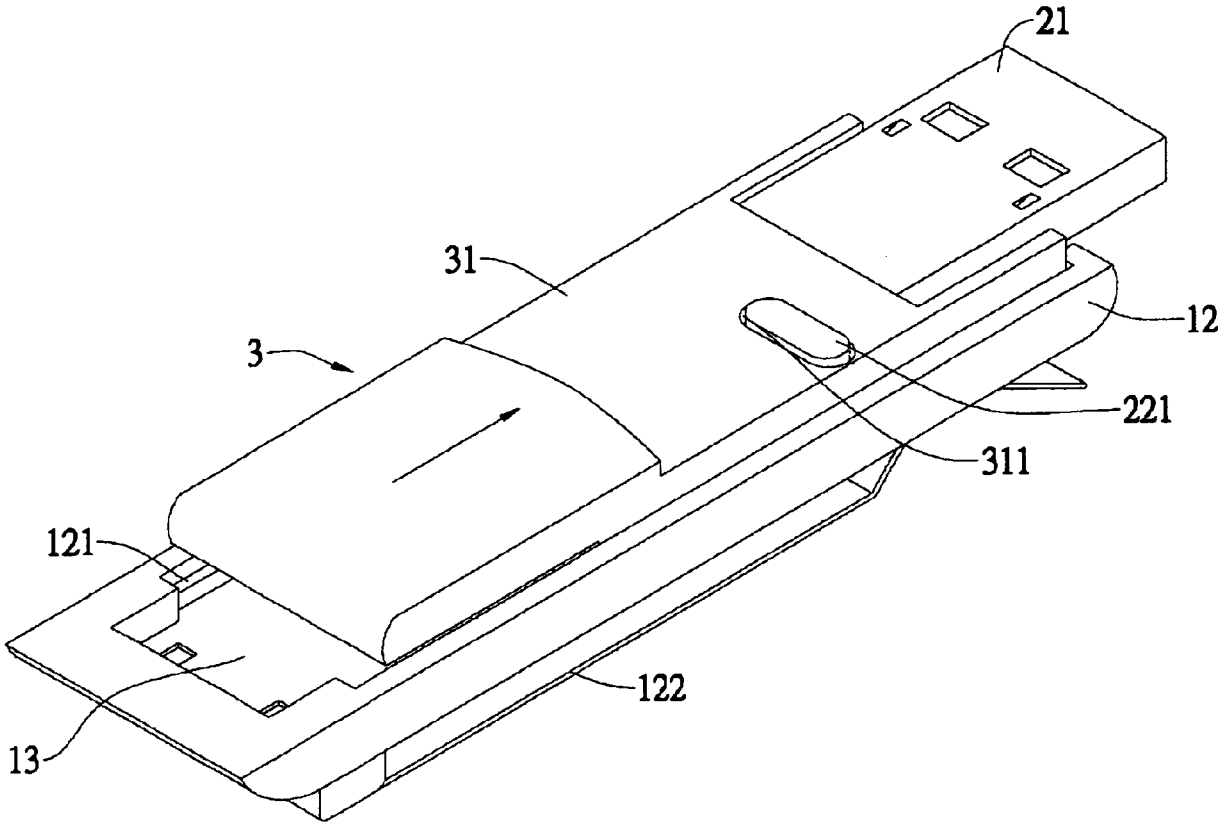
FIG. 4 is a perspective view of the portable storage device of FIG. 2 with an upper case removed from the device to show the operation thereof.
Figure 5:
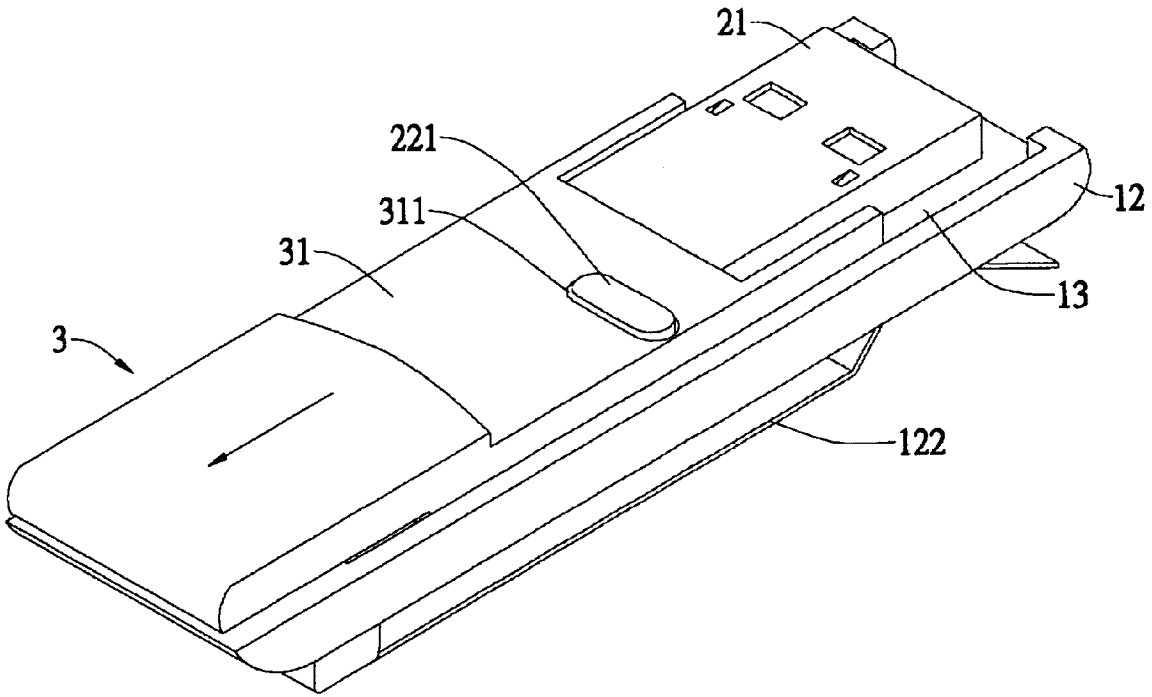
FIG. 5 is another perspective view of the portable storage device of FIG. 2 with the upper case removed from the device to show the operation thereof.
Figure 6:
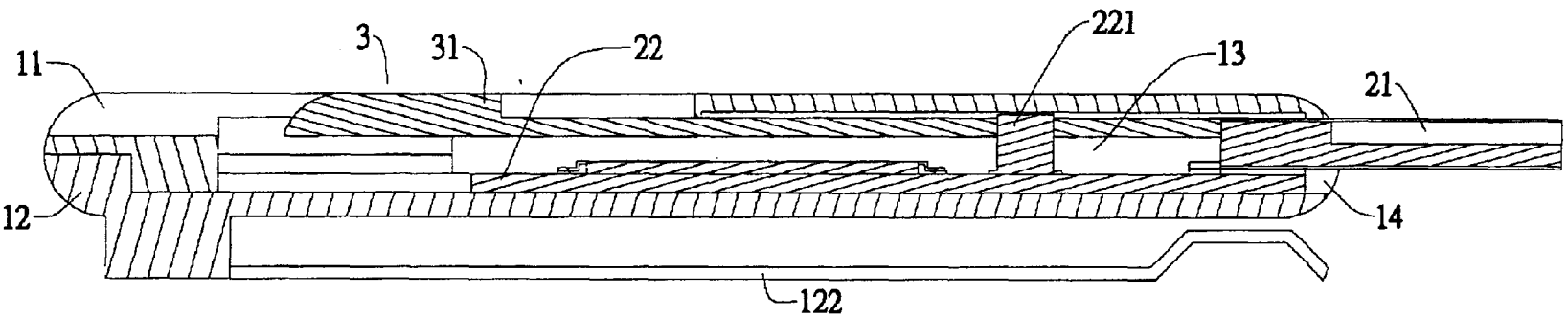
FIG. 6 is a sectional view taken along line A—A of FIG. 3.

Please refer to FIGS. 2 and 3 that are exploded and assembled perspective views, respectively, of a portable storage device with USB according to an embodiment of the present invention. As shown, the portable storage device includes a case 1, a main body 2, and a push member 3.

The case 1 includes an upper case 11 and a lower case 12 which are fitly connected to each other to define a hollow chamber 13 between them. A front end of the chamber 13 is formed into an opening 14. A rear top of the upper case 11 is cut away to form a recess 111, so that a guide channel 112 is defined in the recess 111. The lower case 12 includes two opposite longitudinal walls, on inner sides of which two symmetrical grooves 121 are provided. Meanwhile, a clip 122 is provided to a bottom side of the lower case 12.

The main body 2 includes a connector 21 and a circuit board 22 located behind the connector 21. The connector 21 may be a USB connector, and the circuit board 22 includes a raised electronic element 221 that is normally necessarily included in an electronic circuit.

The push member 3 includes an integrally forward projected extension portion 31. A top of the extension portion 31 is lower than that of a rear portion of the push member 3 located behind the extension portion 31. The extension portion 31 is provided with a hole 311 corresponding to the raised electronic element 221 on the circuit board 22 of the main body 2. Lugs 312 are provided at a bottom side of the extension portion 31 to downward project from four lower corners thereof.

Please refer to FIGS. 3 to 6 at the same time. The main body 2 is longitudinally slidably positioned in the chamber 13 defined in the case 1. The push member 3 is located above the main body 2 with the hole 311 fitly engaged with the raised electronic element 221 on the circuit board 22, and the lugs 312 engaged with the grooves 121 formed at two inner sides of the lower case 12. With these arrangements, the push member 3 is guided by the grooves 121 to freely move to and fro in the chamber 13 of the case 1. The extension portion 31 of the push member 3 is extended into the chamber 13 via the recess 111 of the upper case 11, with the rear portion of the push member 3 located behind and higher than the extension portion 31 longitudinally movably located in the guide channel 112 defined by the recess 111. When the push member 3 is move to and fro relative to the case 1 under guidance of the guide channel 112, the front extension portion 31 also moves to and fro in the chamber 13.

As mentioned above, the main body 2 is longitudinally movably located in the chamber 13, the push member 3 is slidable to and fro under the guidance of the guide channel 112, and the push member 3 is located above the main body 2 with the hold 311 engaged with the raised electronic element 221 to form an interference fit between the extension portion 31 of the push member and the main body 2. Whereby, when the push member 3 is pushed forward, the main body 2 is brought to move forward at the same time. The forward movement of the main body 2 causes the connector 21 at a front end of the main body 2 to project from the case 1 via the front opening 14 of the chamber 13. The projected connector 21 may be inserted into a USB connector provided on a computer to connect the portable storage device to the computer to perform data storage or transmission. When the data storage or transmission is completed, the push member 3 may be pushed rearward to move the main body 2 in a reverse direction and thereby retracts the projected connector 21 into the chamber 13 from outside of the case 1. That is, the connector 21 is fully protected by the case 1 when the portable storage device is not in use. With the present invention, the easily lost cover 5 in the conventional portable storage device is omitted and a user needs not to worry about any possibly lost cover at all.

Figure 7:
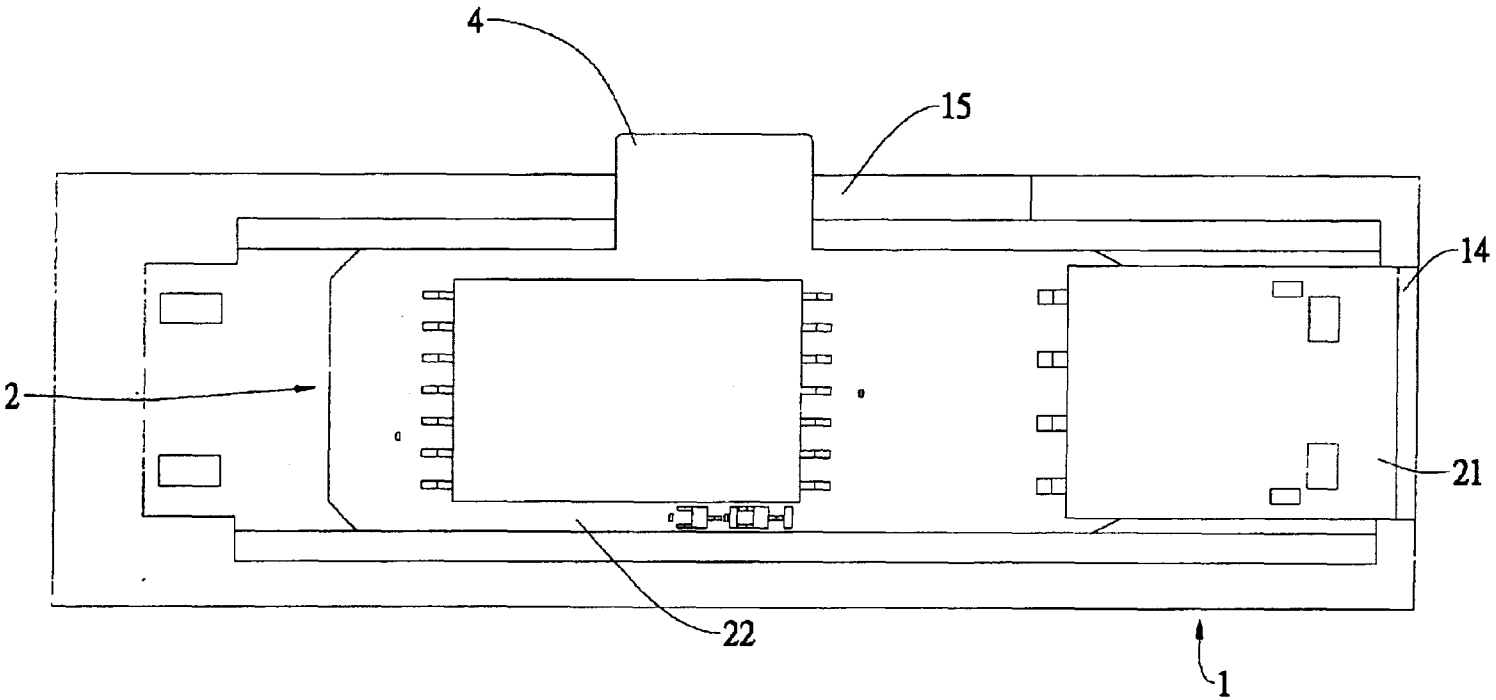
FIG. 7 is a sectioned top view of a portable storage device with USB according to another embodiment of the present invention.

FIG. 7 shows another embodiment of the present invention. In this embodiment, the portable storage device includes a case 1, a main body consisting of a connector 21 and a circuit board 22, and a push member 4. The main body 2 is freely slidable in the case 1 with one side of the circuit board 22, that is, a top or a bottom of the main body 2 that is not shown in FIG. 7, projected from the push member 4. The push member 4 is exposed from a recess 15 correspondingly provided on the case 1, so that the push member 4 may be pushed with a hand to directly bring the main body 2 to slide to and fro in the case 1. The sliding of the main body 2 in the case 1 enables the connector 21 located at a front end of the main body 2 to project from or retract into the case 1.

With the above-described structure, the connector 21 of the main body 2 is movable out of or into the front opening 14 of the case 1 under control. When the portable storage device is not in use, the connector 21 is retracted into and well protected by the case 1. And, when it is desired to use the portable storage device, a user needs only to directly expose the connector 21 by pushing the push member 4 forward relative to the case 1. The portable storage device of the present invention is therefore very convenient for use, and the user needs not to worry about a lost cover at all.

The present invention has been described with some preferred embodiments thereof and it is understood that many changes and modifications in the described embodiments can be carried out without departing from the scope and the spirit of the invention as defined by the appended claims.

What is claimed is:

1. A portable storage device with universal serial bus, comprising:

a case having a longitudinal length and a front opening;

a main body comprising a circuit board and a connector located in front of said circuit board;

said main body being positioned in said case with said connector being movable out of or retractable into said front opening of said case;

a push member being connected to said main body in the manner of interference fit and exposed from said case; and whereby by pushing said push member forward or rearward, said connector of said main body is brought to project from or retract into said case, and said push member does not extend substantially beyond the longitudinal length of said case.

2. The portable storage device with universal serial bus as claimed in claim 1, wherein said push member is formed at a front end thereof with an extension portion; said extension portion being extended into said case via a recess formed on a rear top of said case, and said push member being connected at said extension portion to said main body in the manner of interference fit.

3. The portable storage device with universal serial bus as claimed in claim 2, wherein said extension portion of said push member is provided with a hole for engaging with said main body in the manner of interference fit.

4. The portable storage device with universal serial bus as claimed in claim 3, wherein said circuit board of said main body includes an electronic element adapted to engage with said hole on said extension portion of said push member.

5. The portable storage device with universal serial bus as claimed in claim 2, wherein said recess on said case defines a guide channel for guiding said push member to slide relative to said case.

6. The portable storage device with universal serial bus as claimed in claim 2, wherein said extension portion of said push member is provided at predetermined positions with downward projected lugs corresponding to two grooves provided at two longitudinal inner sides of said case.

7. The portable storage device with universal serial bus as claimed in claim 1, wherein said push member is projected from said circuit board of said main body and a recess of said case.

8. The portable storage device with universal serial bus as claimed in claim 1, wherein said case includes an upper case and a lower case which are fitly connected to each other to define a hollow chamber therebetween.

9. The portable storage device with universal serial bus as claimed in claim 1, wherein said case is provided at a predetermined position with a clip.

* * * * *